United States Patent [19]

Hattori et al.

[11] Patent Number: 4,799,056

[45] Date of Patent: Jan. 17, 1989

[54] DISPLAY SYSTEM HAVING EXTENDED RASTER OPERATION CIRCUITRY

[75] Inventors: Etsuo Hattori, Shiga; Tomoyuki Iwami, Yamato; Yoshihiro Miyazaki, Shiga; Ryutaroh Ohbuchi, Tokyo, all of Japan

[73] Assignee: International Business Machines Corporation, Armonk, N.Y.

[21] Appl. No.: 35,955

[22] Filed: Apr. 8, 1987

[30] Foreign Application Priority Data

Apr. 11, 1986 [JP] Japan ..... 61-82275

[51] Int. Cl.[4] ..... G09G 1/16

[52] U.S. Cl. ..... 340/799; 340/747; 340/750

[58] Field of Search ..... 340/701, 702, 703, 750, 340/747, 799; 364/521, 526

[56] References Cited

U.S. PATENT DOCUMENTS

| | | | |
|---|---|---|---|
| 3,976,982 | 8/1976 | Eiselen . | |
| 4,237,543 | 12/1980 | Nishio et al. | 340/799 |
| 4,484,187 | 11/1984 | Brown et al. | 340/750 |
| 4,496,976 | 1/1985 | Swanson et al. | 340/799 |
| 4,550,315 | 10/1985 | Bass et al. | 340/799 |
| 4,558,438 | 12/1985 | Jones et al. . | |
| 4,607,340 | 8/1986 | Nagai | 340/799 |
| 4,613,852 | 9/1986 | Maruko | 340/799 |
| 4,648,050 | 3/1987 | Yamagami | 340/750 |
| 4,663,619 | 5/1987 | Staggs et al. | 340/799 |
| 4,663,935 | 5/1987 | Novak et al. | 340/750 |
| 4,706,079 | 11/1987 | Kummer et al. | 340/799 |

FOREIGN PATENT DOCUMENTS

| | | | |
|---|---|---|---|
| 55-79486 | 6/1980 | Japan . | |
| 2068699 | 8/1981 | United Kingdom | 340/750 |
| 2099269 | 12/1982 | United Kingdom | 340/799 |

OTHER PUBLICATIONS

Goldberg, A., et al. *Smalltalk 80–The Language and Its Implementation.* pp. 329–362. Addison–Wesley Publishing Co. (1983).

*Primary Examiner*—Marshall M. Curtis
*Assistant Examiner*—Mahmoud Fatahiyar
*Attorney, Agent, or Firm*—Jack Arnold; Marc D. Schechter

[57] ABSTRACT

A display system having a frame buffer comprising a plurality of memory planes, a display device for visually displaying images written into the frame buffer, and a controller for controlling image data operations. The display system is provided with an extended raster operation circuitry comprising an intraplane operation unit and an interplane operation unit. Operation results of the circuitry are written back to the frame buffer. The respective operation units perform operations specified by the controller. The intraplane operation unit performs operations on image data in each of the memory planes, separately, while the interplane operation unit performs operations on image data in at least two memory planes selected by the controller. There are no restrictions as to the positional relation between the intraplane operation unit and the interplane operation unit.

8 Claims, 6 Drawing Sheets

DISPLAY SYSTEM

DISPLAY SYSTEM

INTRAPLANE OPERATION UNIT 14A

INTERPLANE OPERATION UNIT 14B

DISPLAY SYSTEM HAVING EXTENDED RASTER OPERATION CIRCUITRY

TECHNICAL FIELD

The invention is in the field of display systems, and in particular is directed to a display system having a frame buffer comprising a plurality of memory planes, and more particularly to such a display system capable of performing interplane logical operations (raster operations).

BACKGROUND ART

Most of the recent display systems are respectively provided with a frame buffer comprising a plurality of memory planes so that a plurality of bits correspond to one pixel to retain information such as colors, concentrations, etc. There exists a system for manipulating such information in the frame buffer, called the BitBlt. The raster operations which can be performed in the BitBlt system have been defined as the Boolean operations between sources and destinations or between sources, destinations and additionally provided third rectangular areas called patterns or masks. The details of the BitBlt system are described in "Smalltalk-80 The Language and its Implementation," Addison-Wesley, 1983, A. Goldberg and D. Robson, chapter 18. Further, U.S. Pat. No. 3,976,982 discloses an image processing system for performing logical operations of images.

Briefly speaking, the BitBlt is a function of designating a rectangular area in a frame buffer by bits and transferring it to another display area. In its transfer, logical operations such as AND, OR, XOR, etc. are performed on the contents stored in the source and the destination. Therefore, the word is often used synonymously with raster operations. When raster operations are performed in a frame buffer comprising a plurality of memory planes, it is usual to employ a single raster operation circuit in common to all of the planes or to provide a separate raster operation circuit to each of the planes.

In the conventional raster operation circuits, the logical operations have been limited only to each of the memory planes, whether a single raster operation circuit is provided in common to all of them or a separate raster operation circuit is provided to each of them. For example, if a frame buffer is assumed to comprise four memory planes and a source and a destination are denoted with Si (i=0, 1, 2, and 3) and Di, respectively, the conventional raster operation circuits could perform operations such as Di←f (Si, Di) (f is a given logical function), but could not easily perform operations including interplane operations such as shown below.

$$D0 \leftarrow S0 \cdot S1 \cdot D3$$

$$D1 \leftarrow S2 + D2$$

$$D2 \leftarrow (S3 + D2) \cdot S0$$

$$D3 \leftarrow D3$$

The Japanese Patent Unexamined Published Application No. 55-79,486 discloses a display device employing an inter-layer operation circuitry which performs interplane or inter-layer operations. The inter-layer operation circuitry, comprising a plurality of separate logical circuits, is provided between a frame buffer or a refresh memory and a TV monitor. The circuitry has no function to write the operation results back to the refresh memory, and therefore, cannot perform such complex logical operations as mentioned above.

SUMMARY OF THE INVENTION

Accordingly, it is the object of the present invention to provide a display system having a raster operation circuitry extended so as to permit any interplane logical operations to facilitate such complex logical operations.

According to the present invention, it is easily possible to perform any complex logical operations including interplane operations with general-purpose operation circuits.

The present invention may be applied to a display system having a frame buffer comprising a plurality of memory planes, a display device for visually displaying images written into said frame buffer, and a controller for controlling image data operations, and is characterized in that said display system is provided with an extended raster operation circuitry comprising an intraplane operation unit and an interplane operation unit, and that operation results of said circuitry are written back to said frame buffer.

The respective operation units perform operations specified by said controller. The intraplane operation unit performs operations on image data in each of said memory planes, separately, while the interplane operation unit performs operations on image data in at lest two memory planes selected by said controller. There are no restrictions as to the positional relation between intraplane operation unit and the interplane operation unit.

DESCRIPTION OF THE PREFERRED EMBODIMENTS

Figure 1:
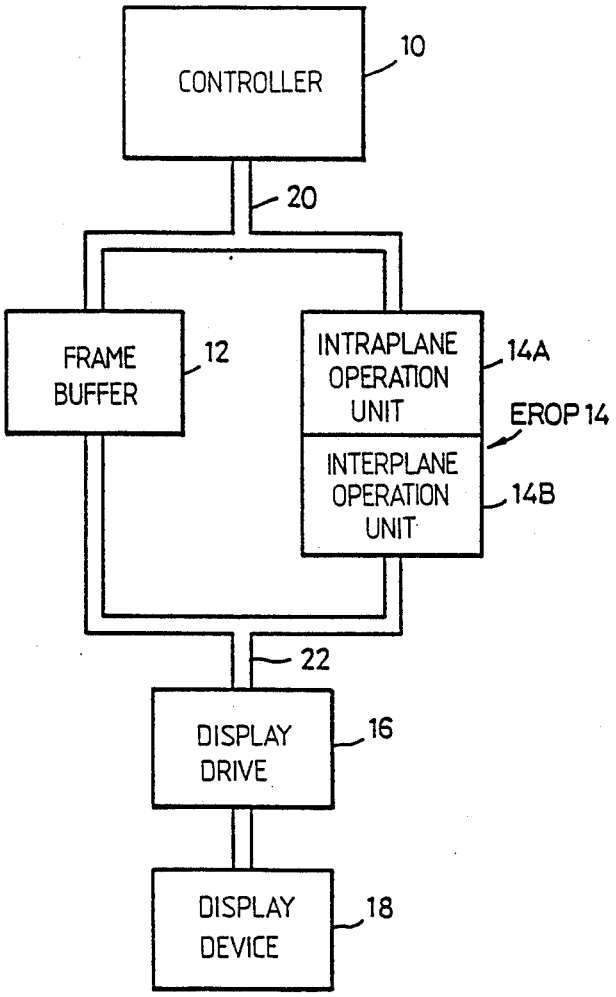
FIG. 1 is a block diagram illustrating a structure of a display system according to the present invention.

FIG. 1 illustrates a structure of a display system according to the present invention. The display system is provided with a controller 10, such as a microprocessor, which controls the entire system, a frame buffer 12 which comprises a plurality of memory planes and into which image data to be displayed are written, an extended raster operation circuitry (EROP) 14 which performs specified raster operations on the image data in the frame buffer 12, a display drive 16 which converts the images read out of the frame buffer 12 into an appropriate form to be displayed, and a display device 18, such as a CRT display, which visually displays the images. The controller 10 writes the images to be displayed into the frame buffer 12 and transfers operation commands to the EROP 14 through a bus 20. Upon receipt of the operation commands, the EROP 14 accesses the frame buffer 12 through a bus 22 and performs the specified raster operations. The images to be displayed in the frame buffer 12 are read into the display drive 16 under the control of the controller 10 to receive necessary processing such as an analog-digital conversion, and then displayed by the display device 18.

Since the controller 10, the display drive 16, and the display device 18 are well known and are not directly related to the present invention, they are not detailed here.

As illustrated in FIG. 1, the EROP 14 is divided into an intraplane operation unit 14A and an interplane operation unit 14B. The intraplane operation unit 14A, which corresponds to the conventional raster operation circuits, performs the operations in each of the memory planes comprising the frame buffer 12. The interplane operation unit 14B, which is a hardware newly provided in accordance with the present invention, performs the operations between the memory planes. Although, in the present embodiment, the frame buffer 12 comprises four memory planes, the present invention is not limited thereto, but may also be applied to other frame buffers comprising different numbers of memory planes in the similar manner.

Figure 2:
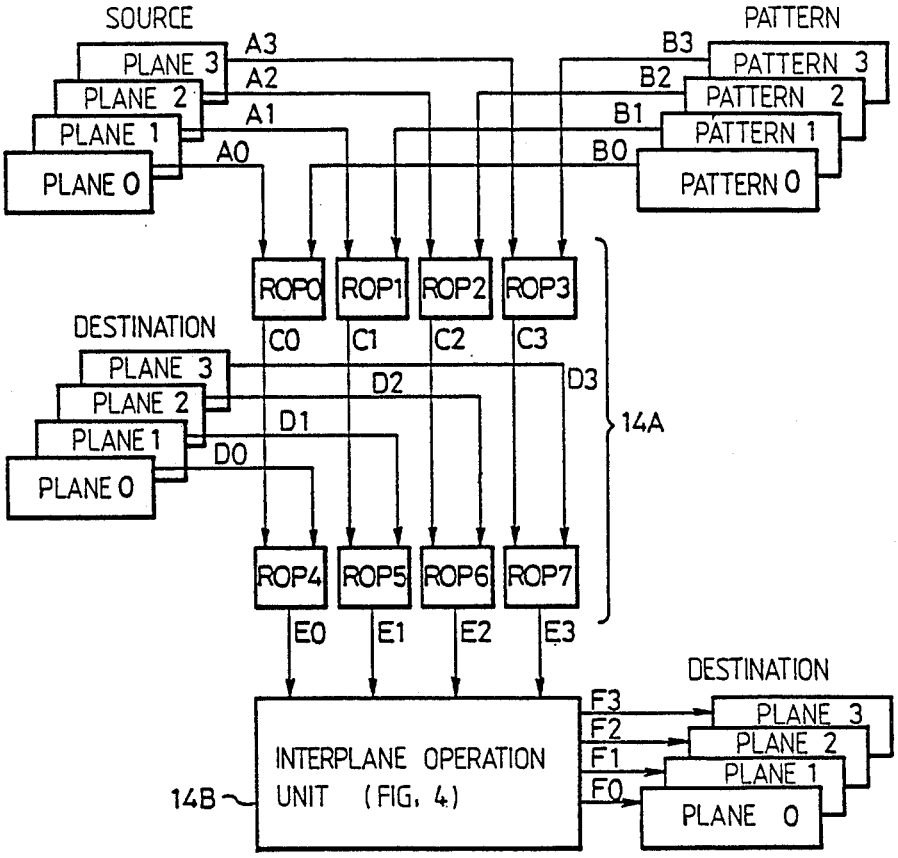
FIGS. 2 and 2A are a block diagram illustrating concepts of the interconnection between the frame buffer and the extended raster operation circuitry (EROP).

The frame buffer 12 and the EROP 14 may conceptually be interconnected as illustrated by FIG. 2. In the example illustrated by FIG. 2, the intraplane operation unit 14A comprises eight raster operation circuits ROP-0–ROP7. A first group of raster operation circuits ROP-0–ROP3 perform the specified operations on the data from the source areas in the planes 0–3 and predetermined pattern, data B0–B3 so that the respective planes correspond. A second group of raster operation circuits ROP4–ROP7 perform the specified operations on the operation results C0–C3 of the first group and the data D0–D3 from the destination areas in the planes 0–3 so that the respective planes correspond. The operation results E0–E3 of the second group are transferred to the interplane operation unit 14B, and the outputs F0–F3 of the interplane operation unit 14B are written into the final destination areas or display areas in the planes 0–3.

The operation of the circuitry illustrated by FIG. 2 may be expressed as follows.

$$Ci = fj\ (Ai, Bi)$$

$$Ei = fk\ (Ci, Di)$$

$$Fi = fe\ (E0, E1, E2, E3)$$

In the above expressions, the i denotes the numbers of the memory planes and the fj, fk, and fe denote the specific logical functions, all of which are specified by the controller 10.

Figure 2A:
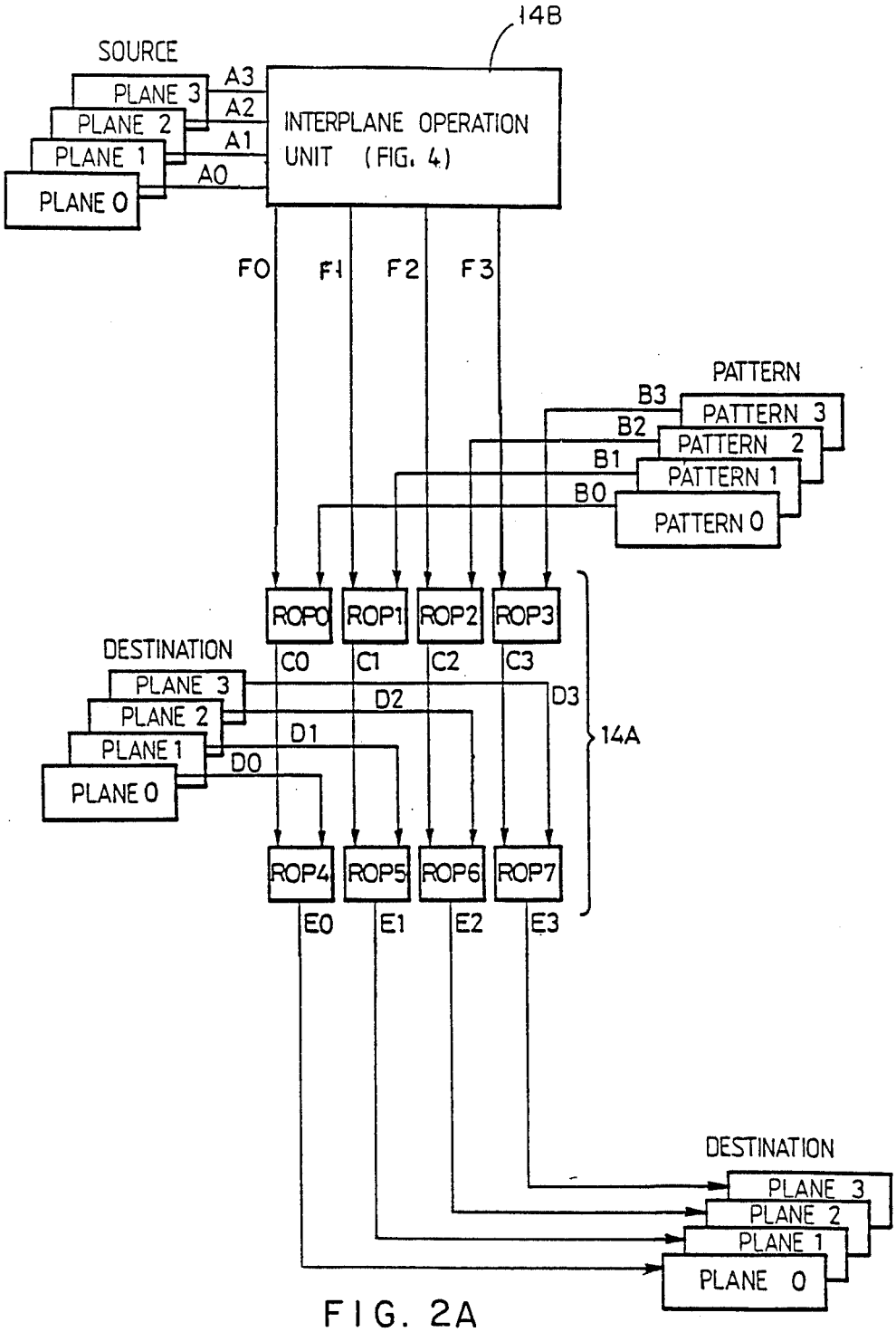

In the example illustrated by FIG. 2, although the intraplane operation unit 14A is followed by the interplane operation unit 14B, their positional relation in hardwares may be vice versa. In that case, as shown in FIG. 2A, the interplane operation unit 14B would receive, as the input, the plane data A0–A3 from the source areas and the operation results F0–F3 would be input into the first group of raster operation circuits ROP0–ROP3 together with the pattern data B0–B3.

The pattern data B0–B3 represent contiguous patterns such as a checkerboard pattern and are supplied from the controller 10 or have been stored in a dedicated pattern memory (not shown) together with other patterns. The pattern data also consist of four bits per pixel.

The intraplane operation unit 14A comprises four raster operation circuits in each group. However, each group may be replaced by a single raster operation circuit so that the data in different planes may be sequentially supplied thereto. Further, the intraplane operation unit itself may be replaced by a single operation circuit.

Figure 3:
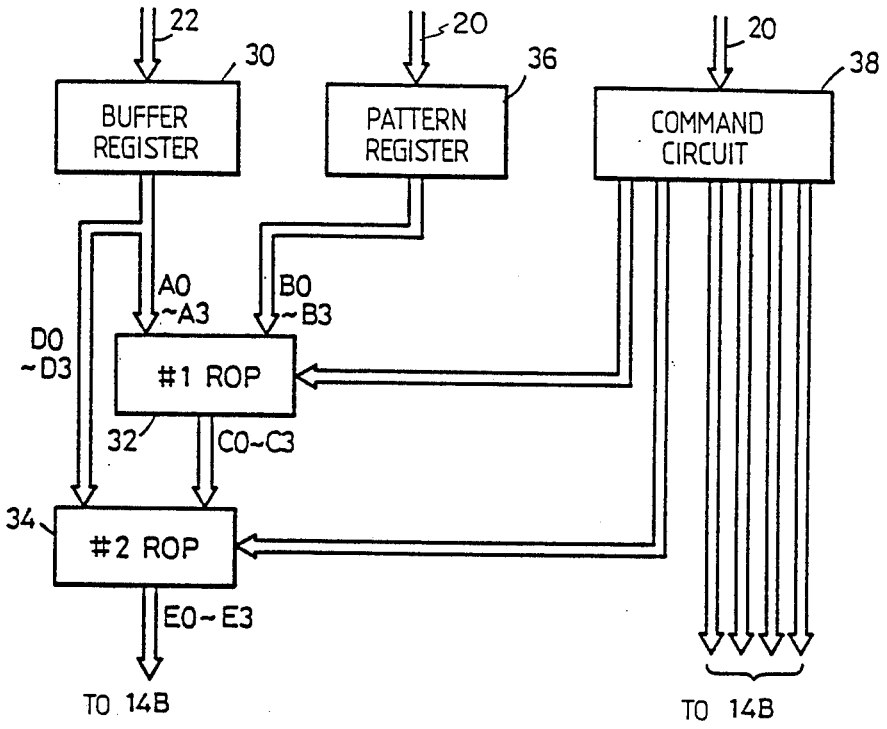
FIG. 3 is a block diagram illustrating a structure of the intraplane operation unit.

FIG. 3 illustrates an example of the structure of the intraplane operation unit 14A. In the illustrated example, the first and second groups of raster operation circuits are shown in blocks as "#1 ROP" and "#2 ROP," respectively. As stated above, each group may be replaced by a single operation circuit. The image data consisting of four bits per pixel read out of the frame buffer 12 (FIG. 1) are loaded into a buffer register 30 through the bus 22. In the present embodiment, it is assumed that one byte of image data are read out of each of the corresponding stored areas in the four memory planes of the frame buffer 12. Therefore, the buffer register 30 requires the capacity of at least four bytes (32 bits). The outputs of the buffer register 30 are connected to the one inputs of the first and second groups of raster operation circuits 32 (#1 ROP) and 34 (#2 ROP). The data A0–A3 from the source areas are supplied to the first group 32, while the data D0–D3 of the destination areas are supplied to the second group 34.

A pattern register 36 receives the pattern data consisting of four bits per pixel from the controller 10 through bus 20, or from a dedicated pattern memory (not shown) and supplies the pattern data B0–B3 to the other inputs of the first group of raster operation circuits 32. The outputs of the first group of raster operation circuits 32 are connected to the other inputs of the second group of raster operation circuits 34 to supply the operation results C0–C3 thereto. The second group of raster operation circuits 34 output the final operation results E0–E3 of the intraplane operation unit 14A and transfer them to the interplane operation unit 14B.

The commands which specify the operations to be performed in the first and second groups of raster operation circuits 32 and 34 as well as in the respective raster operation circuits in the interplane operation unit 14B, to be explained later, are transferred from the controller 10 to a command circuit 38 through the bus 20. Each of the raster operation circuits performs the operations specified with operation specifying signals, namely OP codes, from the command circuit 38. In the present embodiment, the OP codes, each consisting of four bits, can specify 16 types of operations, as shown in the following Table 1.

TABLE 1

| OP Code | Operation |
|---|---|
| 0000 | Z = '0' (hexadecimal) |
| 0001 | $Z = X \cdot \overline{Y}$ |
| 0010 | $Z = X \cdot \overline{Y}$ |
| 0011 | $Z = \overline{X}$ |
| 0100 | $Z = \overline{X} \cdot Y$ |
| 0101 | $Z = Y$ |
| 0110 | $Z = X \oplus Y$ |
| 0111 | $Z = \overline{X} + \overline{Y}$ |
| 1000 | $Z = \overline{X} \cdot \overline{Y}$ |
| 1001 | $Z = \overline{X} \oplus Y$ |
| 1010 | $Z = \overline{Y}$ |
| 1011 | $Z = \overline{X} + \overline{Y}$ |
| 1100 | $Z = \overline{X}$ |
| 1101 | $Z = \overline{X} + \overline{Y}$ |
| 1110 | $Z = \overline{X} + \overline{Y}$ |
| 1111 | Z = 'FF' (hexadecimal) |

In the above Table 1, the X and Y denote the inputs to each operation circuit (X denotes the left input and Y denotes the right input) and the Z denotes the output. Each of the inputs and output consists of one byte and the operations are performed so that the respective bits are corresponded. It is convenient to render the meanings of the OP codes shown in Table 1 the same to all of the operation circuits.

To the respective operation circuits in the interplane operation unit 14B to be described below, the command circuit 38 transfers plane selection signals together with the OP codes. It should be understood that the number and types of the operations which can be performed in the present invention are not limited to those shown in Table 1.

Figure 4:
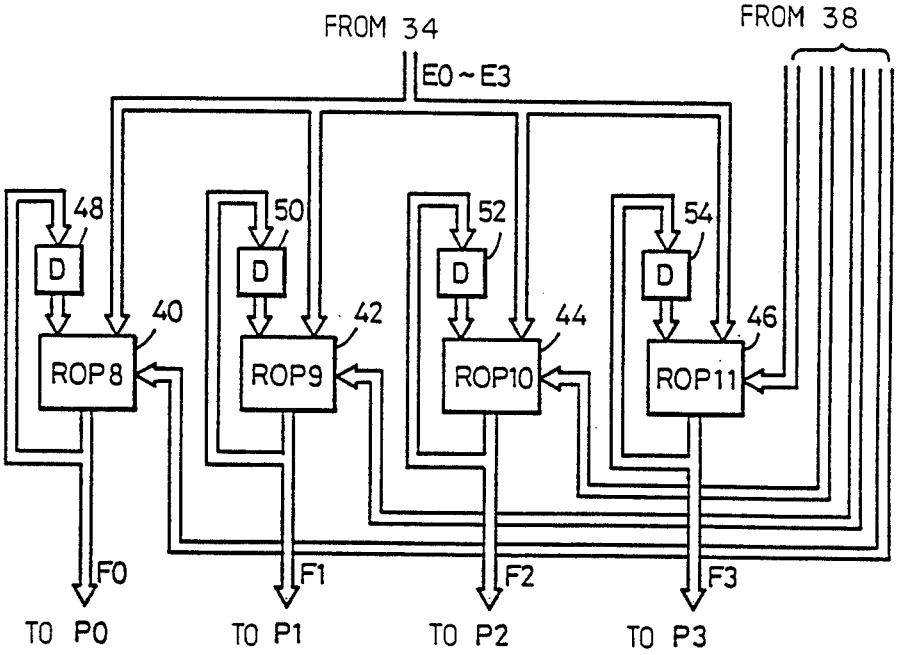
FIG. 4 is a block diagram illustrating a structure of the interplane operation unit.

FIG. 4 illustrates a structure of the interplane operation unit 14B according to the present invention. The interplane operation unit 14B consists of four operation circuits 40 (ROP8), 42 (ROP9), 44 (ROP10), and 46 (ROP11), each of which is provided for each of the planes, and four eight-bit-delay registers 48, 50, 52, and 54, each of which returns the output of each of the operation circuits back to one of the inputs thereof with the delay of one cycle. The one of the inputs of each of the operation circuits is connected to the output of the related delay register (D), while the other of the inputs thereof is connected to the outputs of the second group of raster operation circuits 34. The operations to be performed by the respective operation circuits 40–46 are specified with the OP codes from the command circuit 38. To cause the interplane operation unit 14B to operate, the command circuit 38 supplies the plane selection signals which specify the data of the planes to be manipulated in the respective operation circuits 40–46, together with the OP codes. Each of the plane selection signals consists of four bits, each bit corresponding to each of the different planes, and each of the operation circuits 40–46 receives, as an input, the data of the plane corresponding to "1" bit. The selection of the plane data may be performed with a multiplexer (not shown), for example.

Figure 5:
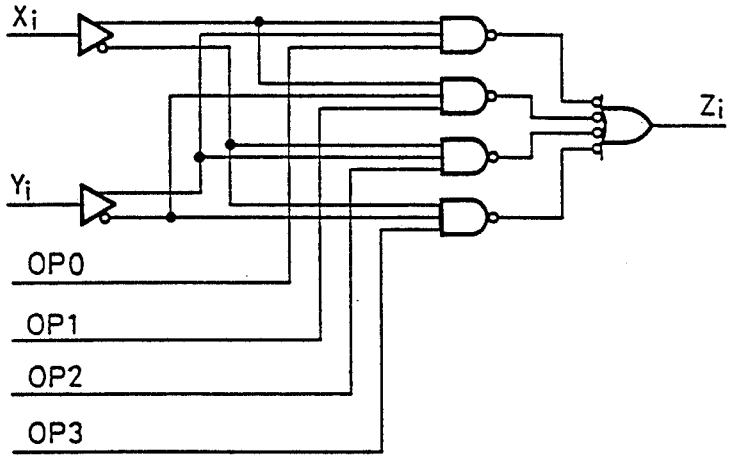
FIG. 5 is a circuit diagram illustrating an operation circuit for one bit.

Each of the operation circuits 40–46 may be the same as each of the ROP0–ROP7 illustrated in FIG. 2, except for the plane selection, and may be a general-purpose operation circuit or a program array logic. FIG. 5 illustrates an example thereof. The circuit illustrated by FIG. 5 performs the operation of the "i"-th bit (i=0, 1, 2, . . . , and 7), and therefore, eight such circuits are required for each of the ROP0–ROP11. As seen from the figure, the logical function of the circuit may be expressed as follows.

$$Zi = Xi \cdot Yi \cdot OP0 + Xi \cdot Yi \cdot OP1 + Xi \cdot Yi \cdot OP2 + Xi \cdot Yi \cdot OP3$$

In the above expression, the Xi, Yi, and Zi denote the "i"-th bits of the X, Y and Z shown in Table 1, respectively and the OP0–OP3 denote the four bits of an OP code to be supplied from the command circuit 38. In the present example, OP0 is the rightmost bit of the OP code and OP3 is the leftmost bit thereof. Thus, depending upon whether each of the OP0 to OP3 is 0 or 1, the operations shown in Table 1 are performed. The details of the operation of the circuit illustrated by FIG. 5 would not be necessary to be explained, and therefore, are omitted here.

Example 1

Extraction of Specified Color

In a color display system, it is a basic function to manipulate the areas of one specific color or the areas of the other colors on a color image surface. In the prior art, as disclosed for example by the applicant's co-pending commonly assigned U.S. Pat. application Ser. No. 523,916 (now U.S. Pat. No. 4,706,079, corresponding to the Japanese Patent Unexamined Published Application No. 60-50,586 filed on Aug. 16, 1983), the comparison of colors has been performed with a dedicated comparator. However, according to the present invention, this can be easily realized with general-purpose operation circuits.

Now assume that the bit configuration of a pixel having a color desired to be extracted in the image written into the frame buffer 12 is P0=1, P1=0, P2=1, and P3=1. The P0–P3 denote the four memory planes comprising the frame buffer 12. Further, assume that the data representing the areas of the color desired to be extracted are to be written into the plane 0 (P0).

The extraction of a color according to the present invention may be accomplished by inverting the image data of the planes having the "0" bits (P1 in the above example) among the four bits of the pixel having the specified color, and then ANDing all the planes. In the present example, the final AND operation results are written into the plane 0 (P0). For the intraplane operation unit 14A, the controller 10 transfers, to the command circuit 38, the commands which cause the operation circuit ROP1 (or ROP5) corresponding to the plane 1 (P1) to perform the operation of $Z=\overline{X}$ and cause the other operation circuits to perform the operation of Z=X. In response to these commands, the command circuit 38 transfers the OP code "1100" to the ROP1 (or ROP5), and transfers the OP code "0011" to the ROP0, ROP2, ROP3, ROP4, ROP5 (or ROP1), ROP6, and ROP7. Thus, at the outputs of the intraplane operation unit 14A, the operation results of E0=A0, E1=A1, E2=A2, and E3=A3 are obtained. In case that the first and second groups of raster operation circuits 32 and 34 comprise respectively a single operation circuit, the command circuit 38 supplies the OP codes stated above in an appropriate sequence.

For the interplane operation unit 14B, the controller 10 transfers, to the command circuit 38, the commands which cause the operation circuit ROP8 corresponding to the plane 0 (P0) to perform the operations and plane selections shown in the following Table 2 and cause the other operation circuits ROP9–ROP11 to perform the operation of Z="00."

TABLE 2

| Cycle | OP Code | Plane Selection |
|---|---|---|
| 1 | 0011 (Z = X) | 0001 (P0) |
| 2 | 0001 (Z = X · Y) | 0010 (P1) |
| 3 | 0001 (Z = X · Y) | 0100 (P2) |
| 4 | 0001 (Z = X · Y) | 1000 (P3) |

The above Table 2 indicates that the operations of one byte are completed by four cycles. The operations may be expressed as follows with the symbols indicated in FIG. 2.

F0=E0·E1·E2·E3

If the two-dimensional size of the image including the areas of the specified color is equivalently n bytes, it would be required to repeat n times the operations of the four cycles shown in Table 2.

Since the ROP9–ROP11 output only the bytes of all zeros in all of the cycles, the image data including only the areas of the specified color are finally written into the final destination area or display area in the plane 0 (P0). In this case, the bit configuration of each pixel becomes "1000," differing from the original one "1011." Thus, in the present example, the areas of the specified color have been extracted by converting the specified color into another color. If it is desired to extract it without such a conversion, it may be accomplished by causing also the ROP10 and ROP11 to perform the same operations as shown in Table 2.

Example 2

Synthesis of Images

In case of monochromatic images, it is possible to synthesize more than two images among the different images written into the four planes, respectively, only by employing OR operations. For example, when the images in the plane 0 and the plane 1 are to be synthesized and written into the plane 3, the ROP0, ROP1, ROP4, and ROP5 are caused to perform the operation of Z=X and the ROP11 is caused to select the plane 0 and the plane 1 and sequentially perform the operations of Z=X and Z=X+Y.

In case of color images, since such OR operations may cause different colors to be produced in overlapping portions, it would be required to synthesize such images by giving priorities thereto. Namely, a color image with a lower priority is synthesized only in the background area of another color image with a higher priority. Since the background area can be extracted with the procedure of Example 1, the background area and the color image with the lower priority are ANDed, and the results and the color image with the higher priority are ORed, thereby to obtain a synthesized image.

Particularly, now assume that a color image having four colors (two bits per pixel) with higher priorities have been written into the plane 0 and the plane 1 and that another color image having four colors with lower priorities have been written into the plane 2 and the plane 3, for example. When the bit configuration of a pixel in the background area is "11" and a synthesized image is to be written into the destination areas in the plane 0 and the plane 1, the operation circuit ROP10, which corresponds to the plane 2 in the interplane operation unit 14B, is caused to perform the operation of F2=E0·E1·E2, and the operation circuit ROP11, which corresponds to the plane 3, is caused to perform the operation of F3=E0·E1·E3. These operations are similar to those shown in Table 2. However, since three planes are ANDed in this case, only three cycles are required for each byte. The operation results are written into the plane 2 and the plane 3, respectively. Next, the operation circuit ROP8, which corresponds to the plane 0, is caused to perform the operation of F1=E0-+E2, and the operation circuit ROP, which corresponds to the plane 1, is caused to perform the operation of F1=E1+E3, thereby to obtain a synthesized color image. Each of the operation circuits ROP0–ROP7 in the intraplane operation unit 14A is specified to perform only the operation of Z=X.

Besides the above, various applications of the present invention are possible.

Having thus described our invention, what we claim as new, and desire to secure by Letters Patent is:

1. A display system comprising:

a frame buffer for storing information representing one or more images, said information being organized into a plurality of memory planes;

a display device for visually displaying images stored in said frame buffer;

an extended raster operation circuit for performing logical operations on information in the frame buffer and for storing the results of the logical operations in the frame buffer; and a controller for controlling the extended raster operation circuit;

characterized in that the extended raster operation circuit comprises:

an intraplane operation unit for performing intraplane logical operations specified by the controller on information in the frame buffer, each intraplane logical operation having at least one input operand and at least one output result, all operands and results of a given intraplane logical operation being in a single memory plane; and an interplane operation unit for performing interplane logical operations specified by the controller on the results of the intraplane logical operations, each interplane logical operation having at least one input operand and at least one output result, the operands and results of a given interplane logical operation being in at least two memory planes.

2. A display system as claimed in claim 1, characterized in that the extended raster operation circuitry comprises:

a buffer register for retaining information read out of the frame buffer; and a command circuit for receiving commands from the controller, said commands specifying logical operations to be performed by the extended raster operation circuitry and specifying the selection of memory planes.

3. A display system as claimed in claim 2, characterized in that:

the intraplane operation unit has an input connected to the buffer register; and the results of the interplane logical operation are written back to the frame buffer.

4. A display system as claimed in claim 3, characterized in that the interplane operation unit comprises:

a plurality of logical operation circuits, one logical operation circuit for each memory plane, each logical operation circuit having first and second inputs and an output, the first input receiving the intraplane logical operation results from any selected memory plane, the output providing results for the associated memory plane in the frame buffer; and a plurality of delay means, one delay means for each logical operation circuit, each delay means having an input and an output, the input of each delay means being connected to the output of the associated logical operation circuit, the output of each delay means being connected to the input of the associated logical operation circuit.

5. A display system comprising:

a frame buffer for storing information representing one or more images, said information being organized into a plurality of memory planes;

a display device for visually displaying images stored in said frame buffer;

an extended raster operation circuit for performing logical operations on information in the frame buffer and for storing the results of the logical operations in the frame buffer; and a controller for controlling the extended raster operation circuit;

characterized in that the extended raster operation circuit comprises:

an interplane operation unit for performing logical operations specified by the controller on the information in the frame buffer, each interplane logical operation having at least one input operand and at least one output result, the operands and results of a given interplane logical operation being in at least two memory planes; and an intraplane operation unit for performing logical operations specified by the controller on the results of the interplane operation unit, each intraplane logical operation having at least one input operand and at least one output result, all operands and results of a given intraplane logical operation being in a single memory plane.

6. A display system as claimed in claim 5, characterized in that the extended raster operation circuitry comprises:

a buffer register for retaining information read out of the frame buffer; and a command circuit for receiving commands from the controller, said commands specifying logical operations to be performed by the extended raster operation circuitry and specifying the selection of memory planes.

7. A display system as claimed in claim 6, characterized in that:

the interplane operation unit has an input connected to the buffer register; and the results of the intraplane logical operation are written back to the frame buffer.

8. A display system as claimed in claim 7, characterized in that the interplane operation unit comprises:

a plurality of logical operation circuits, one logical operation circuit for each memory plane, each logical operation circuit having first and second inputs and an output, the first input receiving information from the frame buffer from any selected memory plane, the output providing results for the intraplane operation unit; and a plurality of delay means, one delay means for each logical operation circuit, each delay means having an input and an output, the input of each delay means being connected to the output of the associated logical operation circuit, the output of each delay means being connected to the input of the associated logical operation circuit.

* * * * *